US006532877B1

(12) United States Patent
Hepburn et al.

(10) Patent No.: US 6,532,877 B1
(45) Date of Patent: Mar. 18, 2003

(54) RAILROAD CAR ROOF PANEL AND SKYLIGHT ASSEMBLY

(75) Inventors: Christopher D. Hepburn, Valparaiso, IN (US); Peter R. Manyek, Highland, IN (US); Richard W. Rentschler, Griffith, IN (US)

(73) Assignee: Stanrail Corporation, Gary, IN (US)

( * ) Notice: Subject to any disclaimer, the term of this patent is extended or adjusted under 35 U.S.C. 154(b) by 0 days.

(21) Appl. No.: 10/051,787

(22) Filed: Jan. 22, 2002

(51) Int. Cl.[7] ..... E04B 7/00

(52) U.S. Cl. ..... 105/404; 105/355; 105/377.08; 105/424; 52/200

(58) Field of Search ..... 277/628, 630, 277/632, 637, 640, 641, 644; 52/200, 17, 45, 214, 204.72, 716.2; 105/377.08, 282.2, 355, 377.01, 404, 424; 296/107.04, 216.07

(56) References Cited

U.S. PATENT DOCUMENTS

| | | | | | |
|---|---|---|---|---|---|
| 753,315 | A | | 3/1904 | Romunder | |
| 1,931,750 | A | * | 10/1933 | Blaski | 52/72 |
| 2,403,061 | A | | 7/1946 | Downes | |
| 3,282,013 | A | | 11/1966 | Boicey | |
| 3,434,251 | A | * | 3/1969 | Kiekhaefer | 52/22 |
| 3,455,073 | A | | 7/1969 | Kiekhaefer | |
| 4,173,854 | A | | 11/1979 | Wallerstein | |
| 4,198,895 | A | | 4/1980 | Ruhl | |
| 4,214,067 | A | * | 7/1980 | Packer | 528/93 |
| 4,259,135 | A | | 3/1981 | Kulla | |
| 4,627,201 | A | | 12/1986 | Hamamoto et al. | |
| 4,860,511 | A | | 8/1989 | Weisner et al. | |
| 4,930,274 | A | | 6/1990 | Cummings et al. | |
| 4,933,227 | A | | 6/1990 | Stewart | |
| 5,061,531 | A | * | 10/1991 | Catalano | 528/93 |
| 5,125,778 | A | | 6/1992 | Sadri | |
| 5,323,576 | A | * | 6/1994 | Gumpert et al. | 52/200 |
| 6,149,164 | A | * | 11/2000 | Kreutz | 277/628 |

* cited by examiner

*Primary Examiner*—Mark T. Le
(74) *Attorney, Agent, or Firm*—Cook, Alex, McFarron, Manzo, Cummings & Mehler, Ltd.

(57) ABSTRACT

A railroad car roof panel and skylight assembly. The assembly includes a rectangular metal roof panel. A pair of corrugations are formed in the roof panel with the corrugations extending longitudinally of the roof panel and spaced apart from one another transversely across the roof panel. A pair of light holes are formed in the roof panel between the corrugations. The light holes are positioned longitudinally of each other with each of the light holes having an inner edge. A translucent plastic window is located above each light hole. Each transparent window has a shape similar to but larger than the shape of its light hole and is positioned to overlie the inner edge of its light hole. The transparent plastic window may be planar or dome shaped. A ring shaped gasket formed of an elastomer such as EPDM has an annulus of rectangular transverse cross section with a thickness greater than that of the translucent window. The gasket also has an integrally outwardly extending brim which is thinner than the annulus. An inwardly opening groove is formed in the annulus with the groove sized to receive an edge of the translucent plastic window. An annular clamp ring is positioned on the ring shaped gasket. The clamp ring has a first portion engaging the annulus and a second offset portion engaging the brim of the gasket. A series of swaged lockbolts extend through the metal roof panel and the clamp ring to clamp the gasket and translucent plastic window there between.

15 Claims, 4 Drawing Sheets

RAILROAD CAR ROOF PANEL AND SKYLIGHT ASSEMBLY

BACKGROUND AND SUMMARY OF THE INVENTION

Skylights have been installed in buildings and vehicles of various types but a practical, economical and leak resistant skylight for a railroad boxcar which also provides resistance to unauthorized entrance has, so far, eluded railroad car manufacturers. The failure to provide a practical skylight for a railroad boxcar may be due to the nature of the roof structures of railroad boxcars and because of the demanding service to which railroad cars are subjected. A conventional boxcar roof is assembled of rectangular sheets of 12 or 14 gauge galvanized steel which have been strengthened with pyramidal corrugations to form roof panels. The roof panels, which are preformed, are positioned on top of the boxcars with the longer dimension of each panel extending between the side walls of the cars. The panels are then connected by rivets and roof seam caps provided over adjacent edges of roof panels to prevent leakage.

This invention is directed to a standard size roof panel of galvanized metal for installation as a portion of a roof of a railroad boxcar which panel incorporates a pair of skylights. The roof panel of this invention can be economically preformed and assembled on a boxcar using conventional assembly techniques. Since it is a conventionally sized panel, it can be interfitted with other standard boxcar roof panels so as to locate the skylights adjacent the ends of the car as required to provide adequate lighting inside the boxcar. The skylights must not unduly reduce the strength and rigidity of the roof panel in which they are provided and must provide long term resistance to water leakage and resist unauthorized entrance to the boxcar.

An object of this invention is a standard dimensioned boxcar roof panel having leak resistant skylights formed therein which leak resistance is obtained without the use of caulking.

Another object of this invention is a roof panel for a railroad boxcar containing skylight openings in which these openings are located in low stress regions of the roof panel.

Another object of this invention is a roof panel containing skylights in which it is necessary to eliminate only one pyramidal corrugation of a conventional roof panel to install the skylight openings.

Yet another object of this invention is a skylight assembly having a gasket extruded from an EPDM polymer with a solid inner core located at the center of a pattern of bolts connecting the gasket to the roof panel.

Still another object of this invention is a sealing arrangement for a polycarbonate skylight window in which a polycarbonate window is seated in a notch in an EPDM polymer gasket and the gasket is clamped by a clamp ring by a pattern of lock bolts arranged around the gasket.

Yet another object of this invention is a railroad car roof panel containing skylights which retains most of its original stiffness by the installation of clamp rings around each skylight opening to replace the stiffening effect lost by removal of sheet metal for the skylight openings and removal of the corrugation normally formed in the area of the panel now occupied by a skylight.

An additional object of this invention is a skylight for a boxcar roof having a window portion which may be either flat or domed.

Another additional object of this invention is a skylight for a boxcar which limits the passage of ultraviolet light into the boxcar.

A further additional object of this invention is a skylight which resists unauthorized removal of the window.

An additional important object of this invention is a skylight for a boxcar which can be used in a wide range of ambient temperatures without leakage of water into the boxcar.

Other objects of the invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
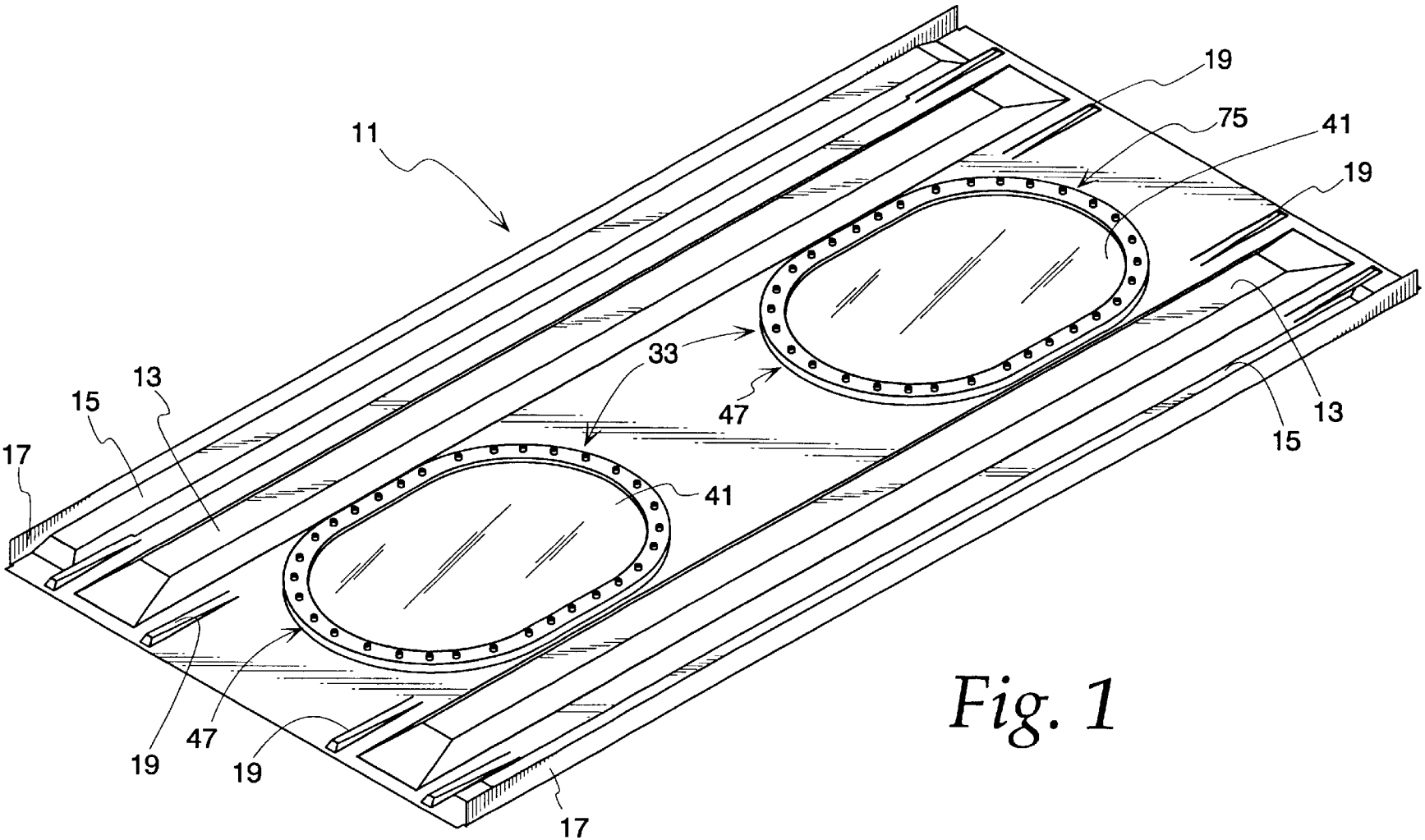
FIG. 1 is an orthographic view of a railroad boxcar roof panel containing the skylights of this invention.
Figure 2:
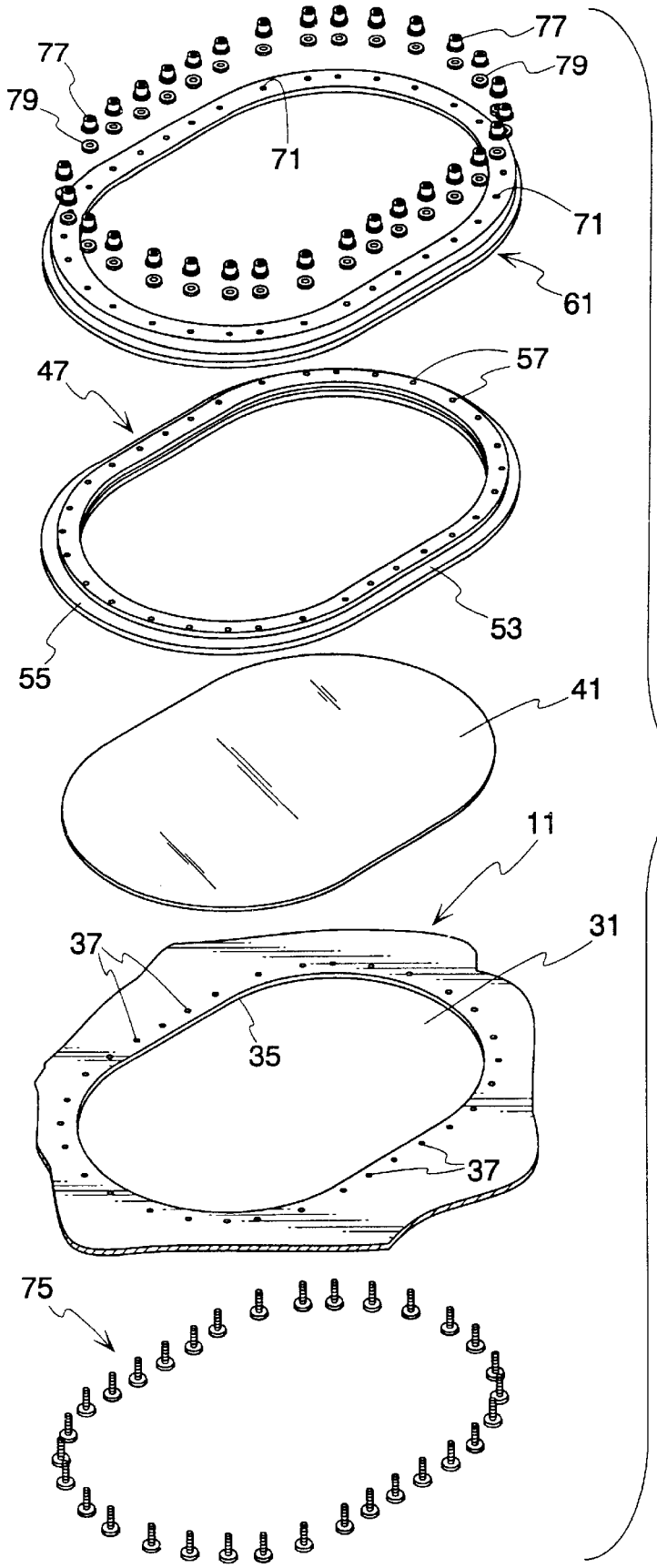
FIG. 2 is an exploded view of a railroad boxcar skylight of this invention.

FIG. 1 of the drawings shows a roof panel 11 embodying the novel aspects of a first embodiment of this invention. Such a roof panel is intended for installation as a second panel inwardly from each end of a railroad car but can be installed in practically any panel of a boxcar roof. This panel conventionally is formed of 12 gauge galvanized steel having formed dimensions of approximately 53½" wide and 112⅛" long. However, it should be understood that this invention is adaptable to roof panels of other sizes. As is conventional, the roof panel 11 includes pyramidal corrugations 13 which run the length of the panel and marginal panels 15 located laterally outwardly of the corrugations 13. Each panel also has turned up edges 17 on opposite sides to be received in roof seams, which are not shown, but are conventional in the construction of railroad boxcar roofs. Pleats 19 are also provided in the roof panel which take up excessive metal at the edges of the panel occasioned by the forming of the corrugations 13 and the marginal panels 15.

A pair of generally oval shaped openings 31 are cut out of the roof panel 11 between the corrugations 13 to form the skylight 33. Each cutout has an inwardly facing edge 35 defining its oval shaped opening. A series of bolt holes 37 are cut in the roof panel 11 outwardly of the edge 35 of the opening 31 to receive bolts to be later described. A generally oval shaped planar piece 41 of a translucent polycarbonate is formed to function as a window for the skylight 33. The polycarbonate is preferably ¼" thick and is sold under the trademark LEXAN by E. I. DuPont de Nemours & Co. The top or outer surface of the polycarbonate has a UV inhibiting coating applied to it to protect contents of the railroad car from ultra violet ray damage. A gasket 47 is formed from an extruded EPDM polymer molded into a ring by vulcanizing the ends of the extrusion. The gasket includes a annulus 51 which is thicker than the window 41. The annulus 51 contains a radially inwardly opening groove 53 which receives the outer edge of the window 41. Also integrally formed with the annulus 51 of the gasket is an outwardly extending brim 55 which is not as thick as the annulus. Bolt holes 57 are punched or drilled through the annulus and are located radially outwardly of the groove 53 of the gasket. The bolt holes are formed with smaller diameters than the bolts (described later) which will be tightly received in the bolt holes to reduce water leakage around the bolts.

An oval shape clamp ring 61 which is preferably formed of 9 gauge steel includes a first annular portion 67 and a second offset annular portion 69. The first and second annular portions are formed using a one hit die. A second die is used to trim the outer perimeter of the annular portion 69. A third one hit die removes the inner oval portion of the clamp ring and punches bolt holes 71 in the first annular portion 67 of the clamp ring. The same die is used to form the cutouts 31 in the roof panel as well as the bolt holes 37 in the roof panel. The clamp ring is electroplated with zinc yellow dichromate to provide protection against corrosion.

Figure 4:
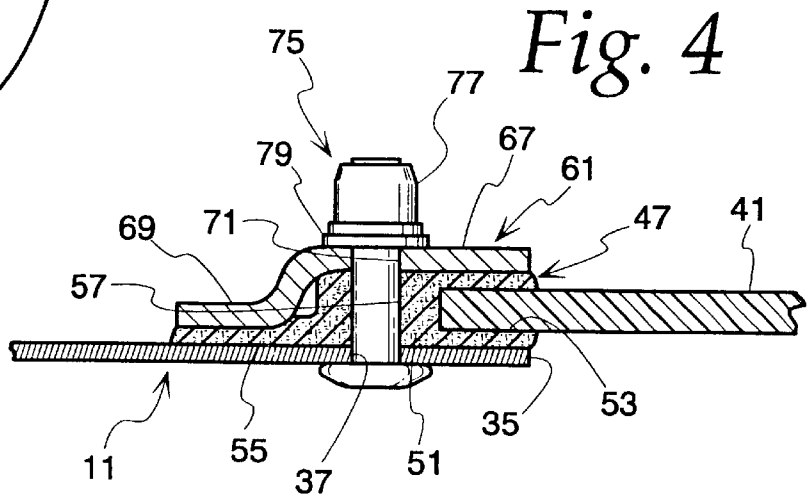
FIG. 4 is an enlarged partial cross sectional view showing the attachment of the skylight window to the roof panel.
Figure 3:
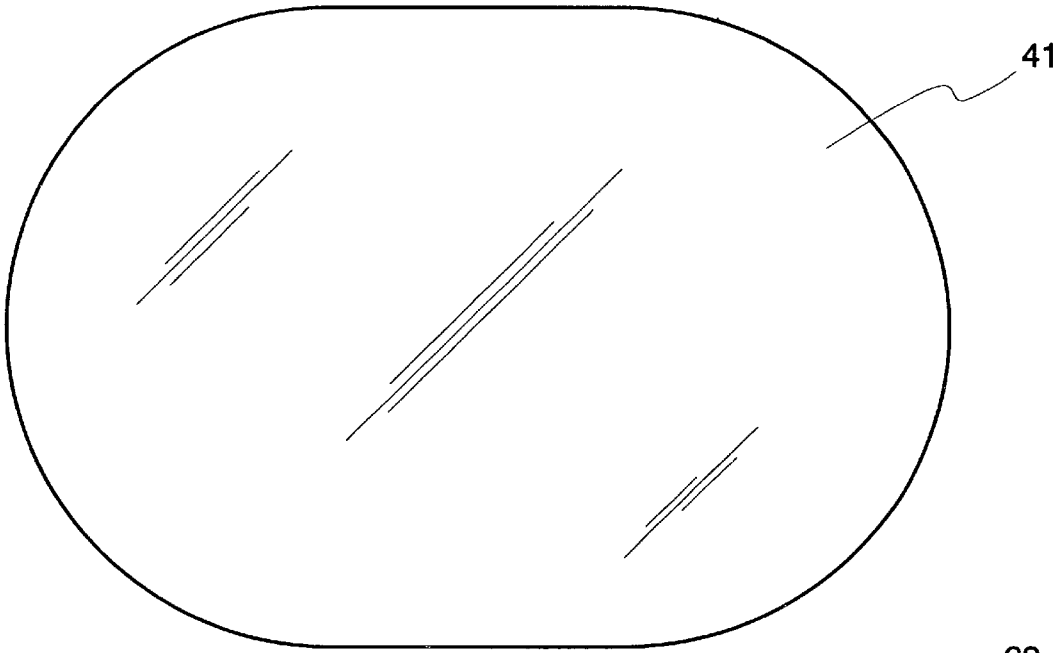
FIG. 3 is a plan view of the polycarbonate skylight window of the skylight of this invention.

Lock bolts 75 manufactured by the Huck Manufacturing Company of Irvine, Calif. are used to clamp the ring 61 against the annulus 51 and brim 55 of the gasket 47 and into contact with the roof panel 11 while also clamping the window 41 into the groove 53 of the gasket as shown most clearly in FIG. 4 of the drawings. A lock nut 77 fits over an EPDM washer 79. The lock bolt is tightened to an 1800 lb. load which swages the lock nut 77 on to the lock bolt 75 so that it must be cut away to be removed thus providing security against unauthorized removal of the window 41 and entrance into the boxcar on which it is installed.

The lock bolts 75 provide a positive and uniform clamp load between the window 41, the roof panel 11 and the clamp ring 61 insuring even compression of the gasket 47. The compressed gasket 47 tightly engages the roof panel 11 and the window 41 to prevent the leakage of water into the boxcar without the need to use caulkings.

Figure 5:
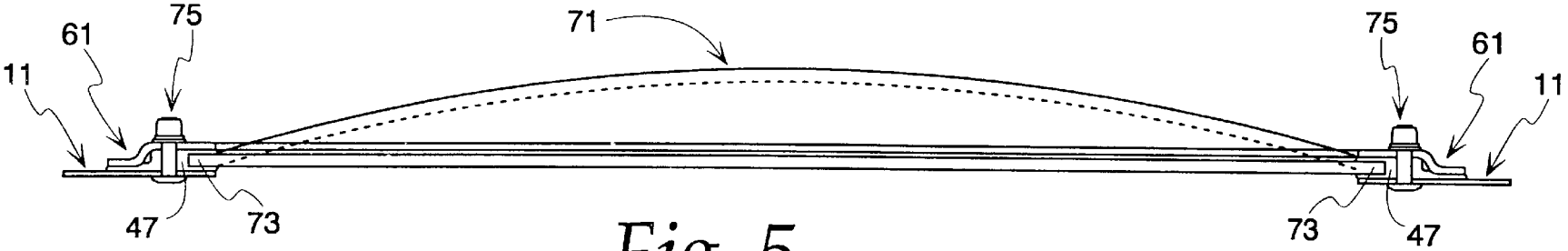
FIG. 5 is a longitudinal side elevational view of a skylight of this invention having a domed window.
Figure 6:
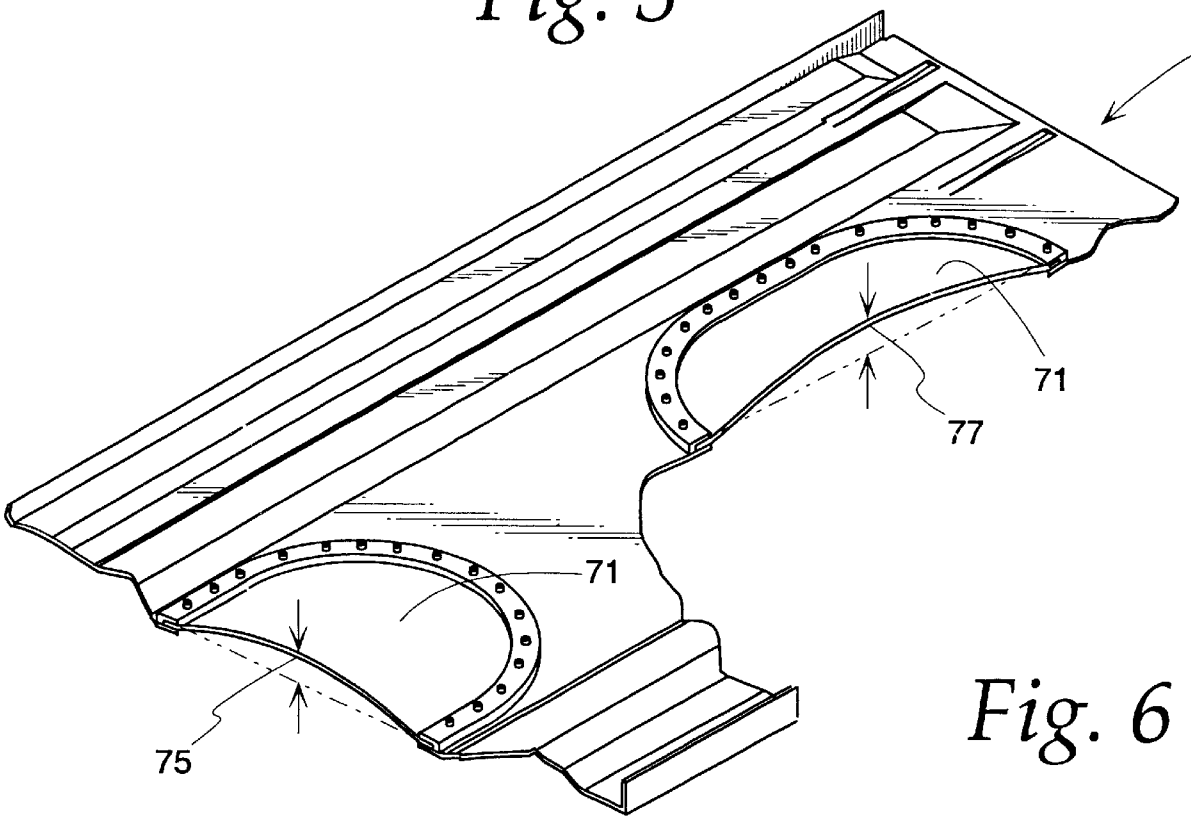
FIG. 6 is an orthographic view of a railroad boxcar panel having a domed window with parts broken away.

A second embodiment of the invention is shown in FIGS. 5 and 6 of the drawings. The roof panel of this embodiment is identical to roof panel 11 of the first embodiment of the invention except that the planar window 41 is replaced by a domed window 71. The components which are the same as those in the first embodiment will be identified by the same numbers.

The window 71 is a translucent polycarbonate preferably ¼" thick which is sold under the trademark LEXAN by E. I. DuPont de Nemours & Co. The outer edges 73 of the oval shaped window are planar to enable the edges to be received into the inwardly opening groove 53 in the annulus 51 of the gasket 47 as shown in FIG. 5 of the drawings. The center portion of the window 71 is shaped like a dome with a bowed cross section in a transverse direction as shown at 75 and in a longitudinal direction as shown at 77 in FIG. 6. The doming of the window 71 increases the strength of the window and prevents the puddling of rain in the center of the window.

What is claimed is:

1. A railroad car roof panel and skylight assembly, including:

a rectangular metal roof panel, a plurality of corrugations formed in said roof panel with said corrugations extending longitudinally of said roof panel and spaced apart from one another transversely across said roof panel, a pair of light holes formed in said roof panel between said corrugations and positioned longitudinally of each other with each of said light holes having an inner edge, a translucent plastic window located in each of said pair of light holes, each of said transparent plastic windows having a shape similar to but larger than the shape of its said light hole and positioned to overlie said inner edge of said light hole, a ring shaped gasket formed of an elastomer and having an annulus of rectangular transverse cross section with a thickness greater than that of said translucent window, said gasket also having an integrally outwardly extending brim which is thinner than said annulus an inwardly opening groove formed in said annulus of said gasket, said groove dimensioned to receive an edge of said translucent plastic window, an annular clamp ring positioned on said ring shaped gasket, said clamp ring having a first portion engaging said annulus of said gasket and a second offset portion engaging said brim of said gasket, and a plurality of bolts connecting said clamp ring and said roof panel to clamp said gasket and said translucent plastic window there between.

2. The railroad car roof panel of claim 1 in which said translucent plastic window is formed of a polycarbonate.

3. The railroad car roof panel of claim 1 in which said translucent plastic window is planar.

4. The railroad car roof panel of claim 1 in which said translucent plastic window is domed.

5. The railroad car roof panel of claim 1 in which said elastomer forming said gasket is EPDM.

6. The railroad car roof panel of claim 1 in which said bolts are swaged lock bolts.

7. A clamp assembly for attaching a translucent plastic window to the metal roof of a railroad car having a light hole cut in said metal roof, said clamp assembly including:

a ring shaped gasket formed of an elastomer and having an annulus of rectangular transverse cross section with a thickness greater than that of said translucent window and an integral outwardly extending brim thinner than said annulus, an inwardly opening groove formed in said annulus of said gasket and dimensioned to receive an edge of said translucent plastic window, an annular clamp ring positioned on said ring shaped gasket, said clamp ring having a first portion engaging said annulus of said gasket and a second offset portion engaging said brim of said gasket, and a plurality of bolts extending through said annulus of said gasket to clamp said gasket and said translucent plastic window to said metal roof panel.

8. The clamp assembly of claim 7 in which said elastomer forming said gasket is EPDM.

9. The clamp assembly of claim 7 in which said bolts are swaged lock bolts.

10. A skylight assembly for a railroad car roof panel having a light hole formed therein, said skylight assembly including:

a translucent plastic window having a shape similar to but larger than the shape of said light hole in said roof panel, a ring-shaped gasket formed of an elastomer and having an annulus of rectangular transverse cross section with a thickness greater than that of said translucent plastic window and an integrally outwardly extending brim thinner than said annulus, an annular clamp ring positioned on said ring-shaped gasket, said clamp ring having a first portion engaging said annulus of said gasket and a second offset portion engaging said brim of said gasket, and a plurality of bolts extending through said annulus of said gasket to clamp said gasket and said translucent plastic window to said roof panel.

11. The skylight assembly of claim 10 in which said translucent plastic window is formed of a polycarbonate.

12. The skylight assembly of claim 10 in which said translucent plastic window is planar.

13. The skylight assembly of claim 10 in which said translucent plastic window is domed.

14. The skylight assembly of claim 10 in which said elastomer forming said gasket is EPDM.

15. The skylight assembly of claim 10 in which said bolts are swaged lockbolts.

* * * * *